United States Patent [19]

Casasent et al.

[11] 4,073,010

[45] Feb. 7, 1978

[54] CORRELATION METHODS AND APPARATUS UTILIZING MELLIN TRANSFORMS

[75] Inventors: David Paul Casasent, Pittsburgh, Pa.; Demetri Psaltis, Thessaloniki, Greece

[73] Assignee: The United States of America as represented by the Secretary of the Navy, Washington, D.C.

[21] Appl. No.: 707,977

[22] Filed: July 23, 1976

[51] Int. Cl.[2] ..... G06G 7/19; G06G 9/00

[52] U.S. Cl. ..... 364/822; 315/364; 340/146.3 Q; 350/3.82; 350/162 SF; 364/515; 364/826

[58] Field of Search ..... 235/181, 197–198; 340/146.3 Q; 350/162 SF, 3.5

[56] References Cited

U.S. PATENT DOCUMENTS

| | | | |
|---|---|---|---|
| 3,614,736 | 10/1971 | McLaughlin et al. | 340/196.3 Q |
| 3,772,563 | 11/1973 | Hasenbalg | 235/198 |
| 3,776,616 | 12/1973 | Douklias | 350/162 SF |
| 3,794,406 | 2/1974 | Kock et al. | 350/162 SF |
| 3,802,784 | 4/1974 | Reynolds et al. | 350/162 SF |
| 3,872,293 | 3/1975 | Green | 235/181 |
| 3,891,968 | 6/1975 | McMahon | 350/162 SF |
| 3,903,407 | 9/1975 | Burnham | 235/181 |

OTHER PUBLICATIONS

Beard, Imaging by Correlation of Intensity Fluctuations, Applied Physics Letters, vol. 15, No. 7, Oct. 1, 1969, pp. 227/229.

Otto et al., Real-time Crosscorrelation with Linear F.M. Surface Acoustic-Wave Filters, Electronics Letters, vol. 11, No. 25/26, Dec. 11, 1975, pp. 643/644.

Gerardi, Application of Mellin and Hankel Transforms, IRE Transact. on Circuit Theory, June, 1959, vol. CT-6, 197/208.

Baudelaire, Linear Stretch Invariant Systems Proceedings, IEEE, vol. 61, Apr. 1973, p. 467/468.

*Primary Examiner*—Felix D. Gruber

*Attorney, Agent, or Firm*—R. S. Sciascia; L. I. Shrago

[57] ABSTRACT

Correlation methods and apparatus are disclosed which make use of Mellin transforms that are scale and shift invariant. There is no loss in the signal-to-noise ratio of the correlation, and data is available for determining any scale difference between the input and reference data.

8 Claims, 5 Drawing Figures

Figure 1:
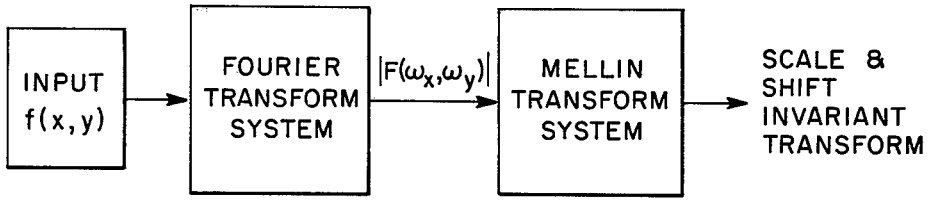

To accomplish the Mellin transform required in the correlation process, the arrangements hereinafter disclosed utilize the Fourier transform. To obtain a scale and shift invariant transform, the procedure shown in FIG. 1 is followed, that is, an input function $f(x,y)$ is first subjected to a Fourier transform which can be easily accomplished by illuminating an appropriate transparency of the data with coherent light and viewing the pattern in the back focal plane of a spherical or Fourier transform lens. This pattern, which is the Fourier transform of the input data, may be detected and recorded on film, TV or any suitable temporary or permanent optical storage means. The magnitude of this transform is then subjected to a Mellin transform, and the result is a scale and shift invariant transform.

There are several different methods of implementing the Mellin transform. In all instances, they involve the logarithmic scaling of the $(x,y)$ input coordinates and the subsequent Fourier transform of the data.

The scaled function $f(\exp x, \exp y)$ of $f(x,y)$ may be calculated by digital means or by suitable signal processing hardware. Alternatively, this scaling can be accomplished by adjusting the input scanning microdensitometer or any other equivalent device used to introduce input data to a digital computer so as to provide appropriate logarithmic samples of this. Once these logarithmic samples are in the computer, any suitable apparatus or technique for carrying out a fast Fourier transform can be employed to yield the Mellin transform of the original data.

The required $x = \exp \xi$, $y = \exp \eta$, and coordinate conversion may also be realized by making use of a computer generated mask. A transparency of the input data is placed in contact with this mask and in the front focal plane of the lens. The light distribution recorded in the back focal plane of this lens will be the desired $f(\exp \xi, \exp \eta)$. The proper computed generated hologram is a phase function $\exp [j \phi (x,y)]$ where $\phi (x,y) = x \ln x - x + y \ln y - y$. This produces a transparency with transmittance $f(\exp \xi, \exp \eta)$. Its optical Fourier transform realized in the conventional manner is recorded for the desired Mellin transform of $f(x,y)$.

Another method of carrying out the Mellin transform involves distorting a transparency having the input function $f(x,y)$ recorded therein so that the film is bent logarithmically in the $x$ and $y$ directions. The optical Fourier transform of such a distorted transparency is the desired Mellin transform. In a somewhat analogous manner, instead of altering the condition of the transparency, a shaped piece of glass fabricated such that its index of refraction and its imaging properties are not uniform but distorted exponentially in the $x$ and $y$ directions may be placed behind it.

Figure 2:
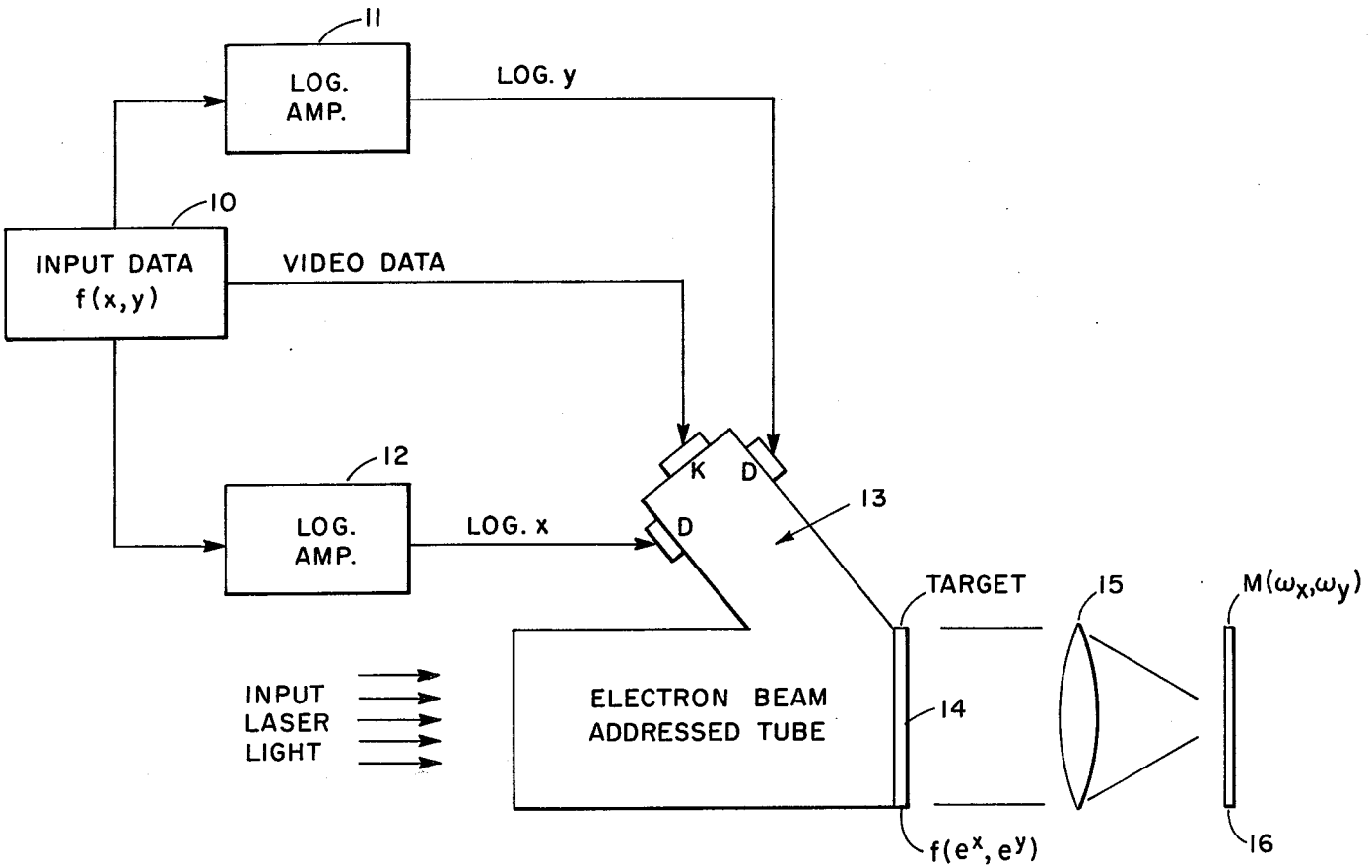
FIG. 2 shows an electro-optic Mellin transform system wherein the spatial light modulator utilizes an electron-beam-addressed target device.

FIG. 2 illustrates an electro-optical arrangement for implementing the Mellin transform in real-time which utilizes a spatial light modulator having an electron-beam-addressed $KD_2PO_4$ light valve. The general construction and operation of this light valve is described in the article, "Dielectric and Optical Properties of Electron-Beam-Addressed $KD_2PO_4$" by David Casasent and William Keicher which appeared in the December 1974 issue of the Journal of the Optical Society of America, Volume 64, Number 12. However, in order to perhaps get a better understanding of the performance of the system of FIG. 2, it would be noted that the light valve has two off-axis electron guns, that is a high resolution write gun and a flood or erase gun. These guns and a transparent $KD_2PO_4$ target crystal assembly are enclosed in a vacuum chamber. Front and rear optical windows allow a collimated laser beam to pass through the crystal which has a thin transparent conduct layer of CdO deposited on its inner surface. The beam current of the write gun is modulated by the input signal as the beam is deflected in a raster scan over the target crystal, and the charge pattern present on the crystal spatially modulates the collimated input laser beam point-by-point.

When this electron-beam-addressed $KD_2PO_4$ light valve is utilized in the Mellin transform apparatus, the input function $f(x,y)$, represented here by signal source 10 which may, for example, be the output from a TV camera, is processed such that the coordinate scaling is accomplished by modifying the waveforms generated by the camera's horizontal and vertical sweep circuits. Hence, the outputs from these sweep circuits are extracted and subjected to logarithmic amplification in amplifiers 11 and 12 before being applied to the beam deflecting apparatus, D, of the light valve 13. The presence of the logarithmic amplifiers in the beam deflection control circuit accomplishes the conversion of the function $f(x,y)$ to $f(\exp \xi, \exp \eta)$. Thus, it is only necessary that the video signal which carries the information content be applied to the appropriate light tube beam electrodes to modulate its beam current. The resultant charge pattern deposited on target 14 is illuminated by laser light from a suitable source not shown, and the Fourier transform accomplished by spherical lens 15 results in the formation of the Mellin transform of the function $f(x,y)$ at the back focal plane 16 of this lens. The pattern so developed may be recorded on any suitable film or optical storage means.

Figure 3:
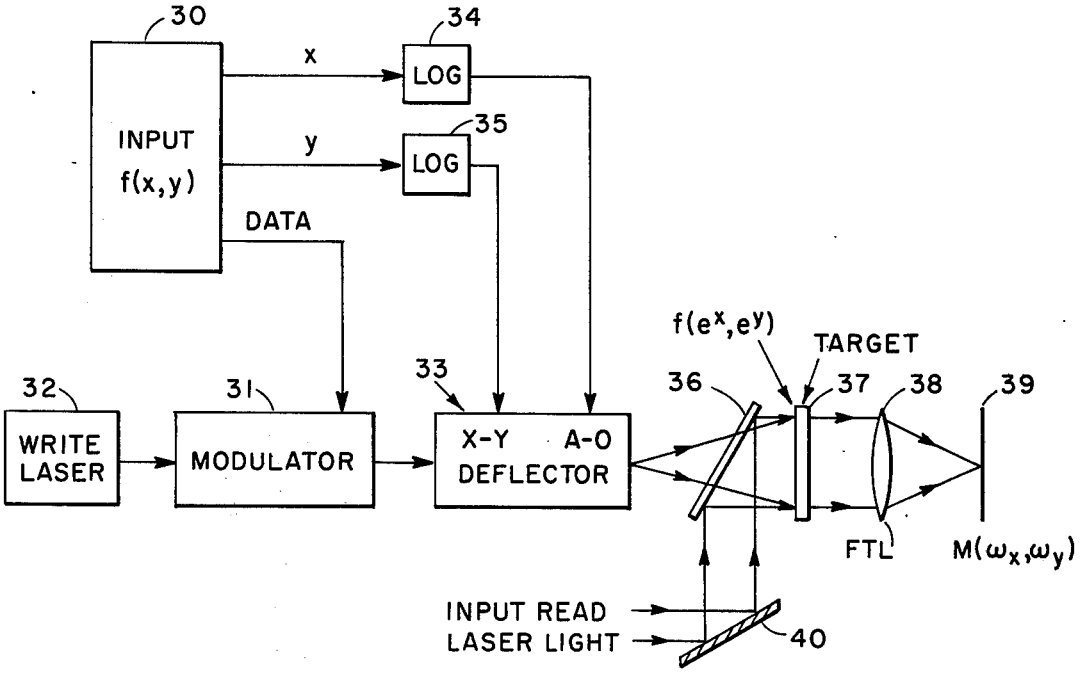
FIG. 3 illustrates a real-time optical Mellin transform system wherein the spatial light modulator utilizes an acousto-optic deflector.

FIG. 3 shows an alternative arrangement for accomplishing the Mellin transform in real-time wherein the input data modulates the intensity of a laser beam whose movement is again controlled by deflecting means with logarithmic amplifiers in its driving circuits. More specifically, $f(x,y)$ represented by source 30 is processed such that the video portion thereof which carries the information content is applied to a modulator 31 which functions to correspondingly vary the intensity of a laser write beam derived from source 32. The modulated light is applied to an $x$-$y$ optic light deflector 33 as the input thereto.

The signals that control the operation of deflector 33 are similar to those encountered in the system of FIG. 2 in that they both have logarithmic relationships with respect to the scale of the two-dimensional input information. However, their particular waveform depends, of course, upon the requirements of the deflector.

The output from the deflector 33, the deflected modulated laser beam, is directed onto an optically sensitive target 37. The image formed on this target whose transmittance is $f(\exp \xi, \exp \eta)$ is illuminated by a read laser whose beam derived from the same source as the write beam, is directed through the target by reflector 40 and

CORRELATION METHODS AND APPARATUS UTILIZING MELLIN TRANSFORMS

The present invention relates generally to two-dimensional data processing systems and, more particularly, to electro-optical correlation apparatus and methods which make use of transforms that are scale and positional invariant.

In the correlation of information such as, for example, data representing objects, scenes or images for pattern recognition or analysis purposes, complications arise when the reference and the input data are not from images or patterns drawn to the same scale.

One approach toward solving this scale discrepancy involves varying the scale of the input data and then correlating the modified data against the reference data. This solution, however, is generally unsatisfactory since it requires a high capacity memory for storing the scaled versions of the data and necessitates lengthy computations for deriving the scaled replicas.

Another approach, which necessitates manipulating the optical components of the correlator, introduces the input image behind the Fourier transform lens rather than at its usual front plane location. By altering the distance from the input plane to the Fourier transform plane, the scale of the Fourier transform is varied. By this means, it is possible to compensate for scale difference. However, since this mode of operation requires intervention in the optical systems, it is not compatible with real-time data processing systems. Additionally, it is only useful in those situations where the scale difference is less than 20 percent.

A further method of compensating for scale variations involves the use of multiple filters or replicas designed to operate with input functions of correspondingly different scales. This, of course, requires a complex optical system and still does not provide assurance that the available reference data will precisely match the input data at any one particular time.

It is, accordingly, an object of the present invention to provide methods of correlation that are effective with differently scaled input and reference data.

Another object of the present invention is to provide a technique that yields correlations on inputs that differ in scale with no loss in the signal-to-noise ratio of the correlation.

Another object of the present invention is to provide an electro-optic correlator whose operation is not adversely affected by a scale difference between the input and reference data and which provides data from which this difference can be determined.

Another object of the present invention is to provide correlating methods which make use of Mellin transforms.

Another object of the present invention is to provide a correlator which makes use of transforms that are scale and shift invariant.

A still further object of the present invention is to provide for electro-optical arrangements performing Mellin transforms.

Briefly, and in somewhat general terms, the present invention accomplishes the above objects of invention by making use of the scale invariant Mellin transform. The Mellin transform M $(u,v)$ of a function $f(x,y)$ can be obtained by taking the Fourier transform of the scaled function $f(\exp x, \exp y)$. The Mellin transform of $f(x)$ along the imaginery axis is $$M(ju) = M(u) = \int_0^\infty f(x)\, x^{-ju-1} dx \tag{1}$$

where $M(ju)$ is written as $M(u)$ hereafter and where only the one-dimensional case is discussed.

It should be appreciated that the transform and all operations connected therewith are easily realized in the two-dimensional case. With the variable change $x = \exp \xi$, it will be seen that the Mellin transform of $f(x)$ is the Fourier transform of $f(\exp \xi)$ $$M(u) = \int_0^\infty f(\exp \xi) \exp(-j\, u\, \xi)\, d\xi \tag{2}$$

This relationship if of critical significance in the digital, analog or optical implementation of this transform since fast Fourier transform (FFT) algorithms and so-called hard wired FFT devices are available and since the Fourier transform can be readily accomplished by optical means.

The scale invariance of the magnitude of the Mellin transform is its pertinent feature. If $f_1(x,y)$ and $f_2(x,y) = f_1(ax,ay)$ are two functions that differ in scale by a factor "$a$", their Mellin transforms, by substitution into (1) or (2) are found to be related to $$M_2(ju,jv) = a^{-ju-jv} M_1(ju,jv) \tag{3}$$

from which we see $$|M_2| = |M_1| \tag{4}$$

or the magnitude of the Mellin transforms of two functions that differ in scale by a factor "$a$" are equal.

The importance of the Mellin transform is thus found in the fact that the magnitude of the Mellin transforms of two functions that are different in scale are equal. In contrast, the magnitude of the Fourier transform is invariant to a shift in the input function but is very dependent on scale changes. As a consequence of this, in matched spatial filtering, for example, the input function and matched filter function must be identical in scale and precisely positioned or a severe loss of signal-to-noise ratio of the resultant correlation will result.

The present invention makes use of a scale and shift invariant transform. Such a transform results if the Mellin transform of the magnitude of the Fourier transforms of the input data is taken. This comes about from the scale invariance of the magnitude of the Mellin transforms and the shift invariance of the magnitude of the Fourier transforms.

Correlators utilizing the Mellin transforms of the present invention not only yield correlations on inputs that differ in scale but they do so with no loss in the signal-to-noise ratio of the cross-correlation as compared to the auto-correlation results. As an additional important benefit, the location of the correlation peak provides information from which the scale difference between inputs can be determined. This latter feature is of value in applications where the scale factor data is utilized to rescale one input so as to enable conventional correlation to be performed.

Other objects, advantages and novel features of the invention will become apparent from the following detailed description of the invention when considered in conjunction with the accompanying drawings wherein:

FIG. 1 illustrates a sequence of operations resulting in a scale and shift invariant transform;

a reflecting coating on the backside of 36. A Fourier transform of the images is accomplished by spherical lens 38, and again the Mellin transform appears in the back focal plane 39 of this lens.

According to the present invention, four methods are disclosed for performing a correlation with Mellin transforms. All of these methods produce scale invariant correlators. However, only two of the methods yield scale and positional invariant correlation. Without the positional invariant characteristic, the two scale functions must be scaled about the origin such that their distance from this point are scaled along with the actual size of the objects or scenes involved. In other words, the entire input plane rather than just the object of concern must be scaled. This requirement places a constraint on the operation of a scale invariant correlator for images or two-dimensional information. However, it is not the case for one-dimensional signals.

Let the two functions to be correlated be represented as $f_1$ and $f_2$, their Mellin transforms by $M_1$ and $M_2$, their Fourier transforms by $F_1$ and $F_2$, the Mellin transforms of $|F_1|$ and $|F_2|$ by $M_1'$ and $M_2'$, and the complex conjugate of any function G by G*. The four methods of correlation may be summarized as follows:

Method One: The inverse Mellin transform of the product $M_1M_2^*$ is the Mellin type correlation $f_1(x) \circledcirc f_2(x)$.

Method Two: The inverse Mellin transform of the product $M_1'M_2'^*$ is the Mellin type correlation $|F_1(w)| \wedge |F_2(w)|$. ○

Method Three: The Fourier transform of $M_1M_2^{\circledast}$ is the conventional correlation $f_1(\exp x) \circledast f_2(\exp x)$.

Method Four: The Fourier transform of $M_1'M_2'^*$ is the conventional correlation $|F_1(\exp w)| \circledast |F_2(\exp w)|$.

One-dimensional functions have been used for simplicity only. The Mellin correlation is defined as $$f_1(x) \circledcirc f_2(x) = \int_0^\infty f_1(y) f_2^*(xy)(1/y)\, dy$$

Substituting $x = \exp \xi$, and $y = \exp \xi$, then reduces to the conventional correlation $f_1(\exp \xi) \circledast f_2(\exp \xi)$. The inverse Mellin transform is equivalent to the inverse Fourier transform of the logarithmically scaled function.

Figure 4:
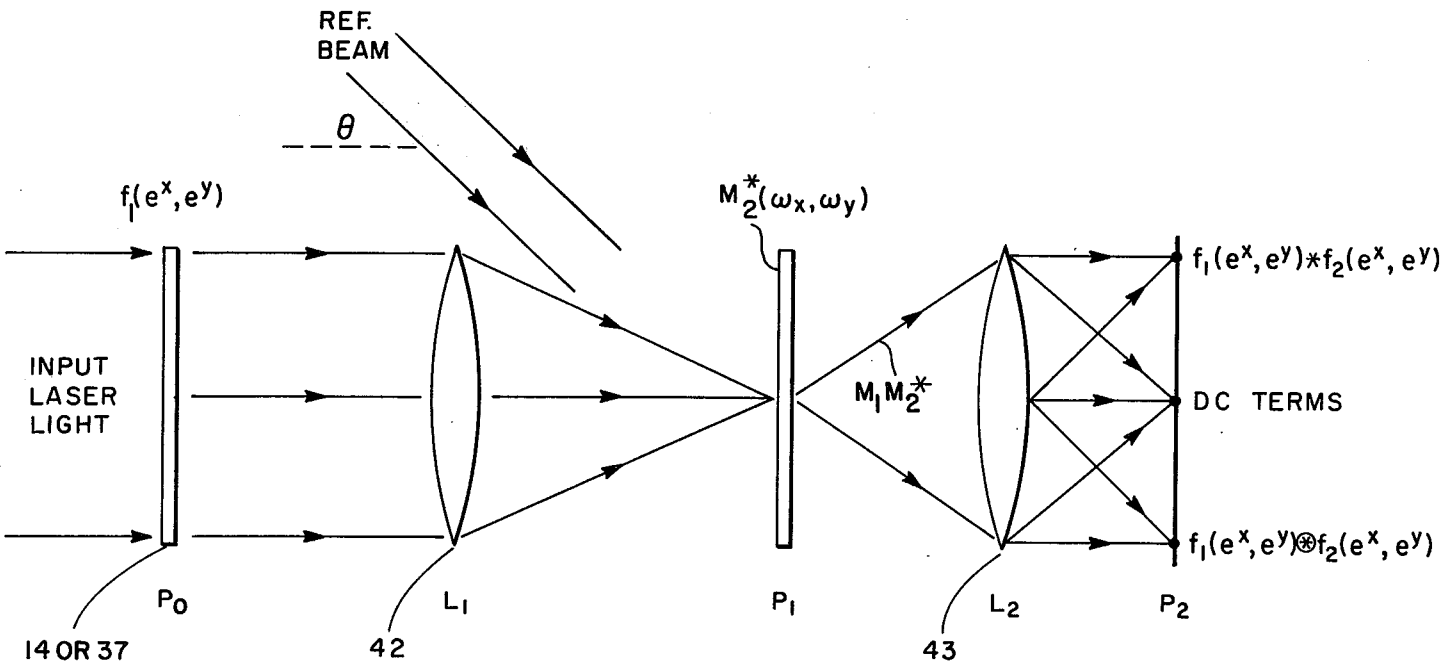
FIG. 4 shows a scale insensitive optical correlator utilizing Mellin transforms in its operation.

FIG. 4 shows an optical arrangement for performing the third method mentioned above. As shown in this Fig., the conjugate Mellin transform $M_2^*$ is formed from the input function $f_2(x,y)$ which may be available as an appropriate image transparency on either the target 14 of the electron-beam-addressed $KD_2PO_4$ light valve in FIG. 2 or the target 37 in the arrangement of FIG. 3. As mentioned hereinbefore, when these targets are illuminated with an input laser light, the pattern appearing at the back focal plane of the Fourier transform lens corresponds to $M_2(u,v)$. If a plane wave reference beam, which may be derived from the input laser, is introduced into the optical system at an angle $\theta$ with the optical axis of the system such that it interferes with the light distribution $M_2$, then the pattern formed by this interaction as recorded in the back focal plane of the Fourier transform lens 42 will contain a term proportional to $M_2^*$. This arrangement corresponds to the normal Fourier transform holographic recording system.

To produce the desired product $M_1M_2^*$ and realize the final correlation, the conjugate Mellin transform $M_2^*$ as recorded in the manner previously described is positioned in the system of FIG. 4 at plane $P_1$. Now the other function $f_1(x,y)$ serves as the input to one of the arrangements such as FIGS. 2 and 3 so that the target image corresponds to $f_1(\exp \xi, \exp \eta)$, and an image having this transmittance is available at $P_0$. With these conditions and the reference beam blocked, the light distribution incident on $P_1$ where the conjugate Mellin transform $M_2^*$ is recorded will be $M_1$, and the light distribution leaving $P_1$ will be the product, namely, $M_1M_2^*$.

Spherical lens 43 forms the Fourier transform of this product at a vertical distance $f \sin \theta$ from the center of plane $P_2$. This is the desired correlation. The location of the correlation peak will be proportional to the scale factor between the two different inputs.

Figure 5:
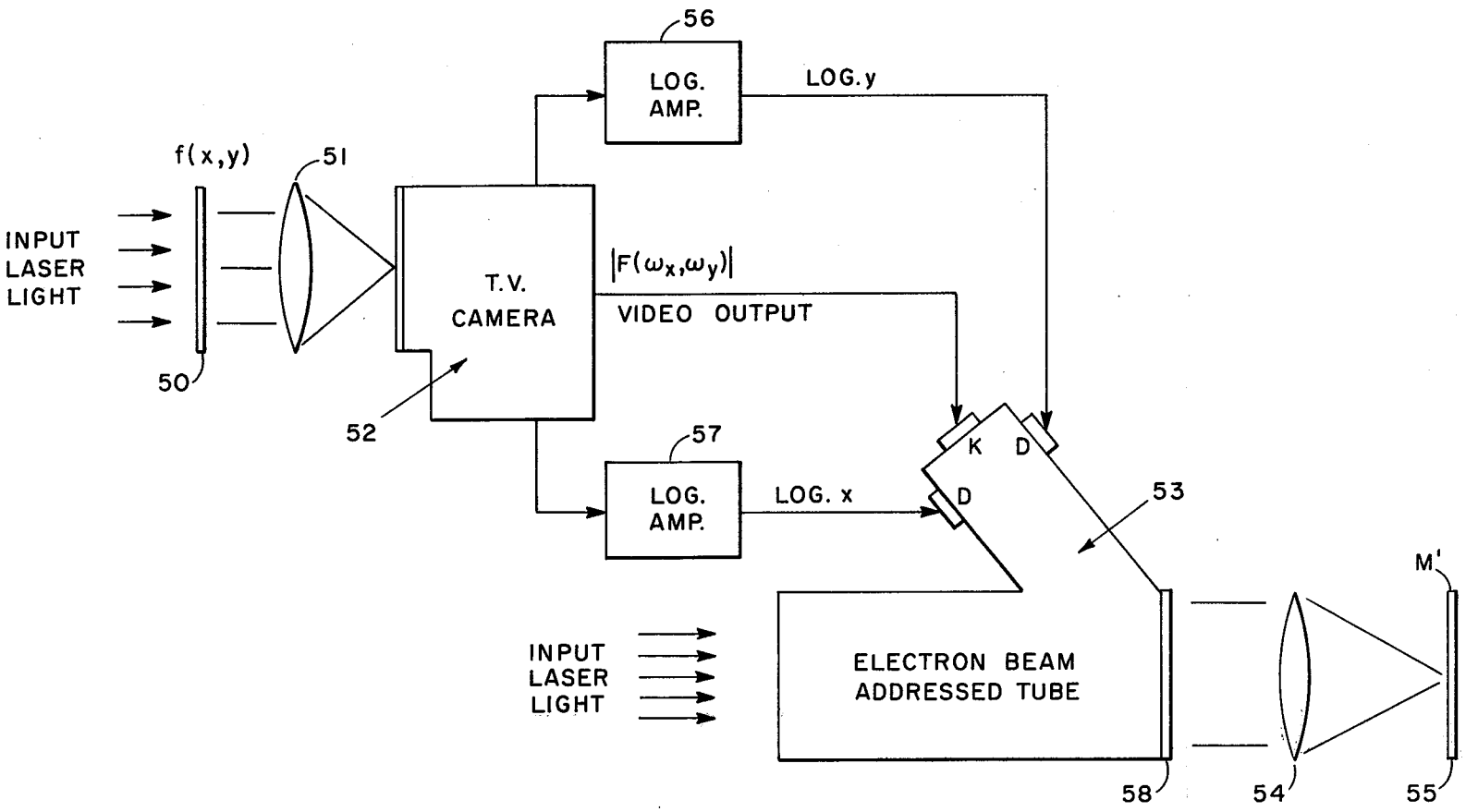
FIG. 5 illustrates an arrangement for deriving the Mellin transform of the magnitude of the Fourier transform of an input function.

FIG. 5 shows an optical arrangement for providing $M_1'$ needed in the fourth method identified above. In this arrangement, the input function $f(x,y)$ available as a transparency, for example, is Fourier transformed and the resultant pattern serves as the input to a TV camera 52. The video output of this camera is controlled by appropriate amplifying means so that it corresponds to the magnitude of the Fourier transform $|F_1|$. This signal, as is the case with the system shown in FIG. 2, is applied to the cathode of the electron-beam-addressed tube 53. The deflection voltages for this tube, derived from camera 52, are logarithmically amplified in circuits 56 and 57 before being applied to tube 53. The image appearing on the tubes target 58 is subjected to a Fourier transform by lens 54 in cooperation with the input laser light. As a consequence, the light distribution pattern appearing at the back focal plane of this lens at location 55 is the Mellin transform of the magnitude of the input function, for example, $M_1'$.

To perform Method Four, the scale and shift invariant correlation process, the conjugate Mellin transform $M_2'^*$ is obtained from the system of FIG. 4 but with $f(e^x, e^y)$ at plane $P_0$ replaced by $|F_2(e^{wx}, e^{wy})|$, the light distribution pattern on target 58 of tube 53 when $f_2(x,y)$ is the input of FIG. 5. The recording of $|F_1(e^{wx}, e^{wy})|$ as obtained from FIG. 5 is now inserted at plane $P_0$ and $M_2'^*$ introduced at plane $P_1$. The reference beam is blocked so that the light leaving $P_1$ is the product $M_1'M_2'^*$, and this product is Fourier transformed by lens 43 to yield the correlation at plane $P_2$.

What is claimed is:

1. In a method of correlating input data which may be in the form of $f_1(x,y)$ with reference data which may be in the form of $f_2(x,y)$ where the scales of said input data differ, the steps of preparing a film transparency which has a transmittance pattern that contains the conjugate of the Mellin transform of one of said functions;

illuminating said film transparency with a light distribution pattern that corresponds to the Mellin transform of the other function;

Fourier transforming the light distribution pattern resulting from said illumination; and recording the results of said Fourier transformation.

2. In a method as defined in claim 1 wherein said film transparency is prepared by interfering a planar light wave with a light distribution pattern that corresponds to the Mellin transform of said reference image and recording on film the interference pattern resulting therefrom.

3. In a method as defined in claim 1 wherein said film transparency is prepared by forming an image corresponding to the Mellin transform of said reference image;

directing a planar reference light wave at said image at an acute angle to the plane of said image; and recording on film the interference pattern resulting from the interaction of said planar reference light wave and said image.

4. In a method of correlating input data which may be expressed as $f_1(x,y)$ with reference data which may be expressed as $f_2(x,y)$ and where $f_2(x,y) = f_1(ax, ay)$, the steps of providing a film transparency which has a transmittance pattern that contains a term that is proportional to the conjugate Mellin transform, $M_2^*$, of the function $f_2(x,y)$;

forming a light distribution pattern that corresponds to the Mellin transform $M_1$ of the function $f_1(x,y)$;

illuminating said film transparency with said light distribution pattern so as to create a light distribution pattern that corresponds to the product $M_1M_2^*$;

Fourier transforming said last-mentioned light distribution pattern; and displaying the results thereof.

5. In a method as defined in claim 4 wherein said light distribution pattern that corresponds to the Mellin transform $M_1$ of the function $f_1(x,y)$ is formed by forming an image which corresponds to $f_1(x,y)$ logarithmically scaled in the $x$ and $y$ directions and Fourier transforming said last-mentioned image.

6. A scale and shift invariant optical correlator for processing input and reference data, comprising in combination a film transparency having recorded therein as variations in its transmittance a pattern which contains the conjugate Mellin transform of said reference data;

means for illuminating said film transparency with a light distribution pattern that corresponds to the Mellin transform of said input data, said illumination producing a product light distribution pattern which corresponds to that obtained by multiplying the conjugate Mellin transform of the reference data and the Mellin transform of said input data;

means for Fourier transforming said product light distribution pattern; and means for recording the results of said Fourier transformation.

7. A scale and shift invariant optical correlator, comprising in combination a frequency plane optical correlator having an input plane, a frequency plane and an output plane;

a film transparency positioned at said frequency plane, said film transparency having recorded therein as transmittance variations a pattern which contains a term that is proportional to the conjugate of the Mellin transform of a reference image; and means for producing at the input plane of said correlator a light distribution pattern which corresponds to the Mellin transform of an input image, said light distribution pattern being Fourier transformed in said optical correlator with the light distribution pattern resulting therefrom illuminating said film transparency and the light distribution pattern resulting from this illumination being Fourier transformed in said optical correlator with the results thereof appearing in said output plane; and means for recording the light distribution pattern appearing at said output plane.

8. In a method of correlating input data which may be expressed as $f_1(x,y)$ with reference data which may be expressed as $f_2(x,y)$ and where $f_2(x,y) = f_1(ax, ay)$, the steps of providing a film transparency that has a transmittance pattern that contains a term that is proportional to the conjugate Mellin transform, $M_2^*$, of the function $f_2(x,y)$;

forming a transmittance pattern that corresponds to $f_1(x,y)$ logarithmically scaled in the $x$ and $y$ directions;

illuminating said last-mentioned transmittance pattern with a laser beam;

Fourier transforming the light distribution pattern resulting from said illumination;

illuminating said film transparency with the light distribution pattern resulting from said Fourier transformation;

Fourier transforming the light distribution pattern resulting from said last-mentioned illumination; and displaying the results thereof.

* * * * *